United States Patent [19]

Schimmel

[11] 4,055,321

[45] Oct. 25, 1977

[54] INSIDE CONCRETE COREWALL FORM WITH PARTICULAR THREE-WAY HINGE ASSEMBLIES THEREFOR

[75] Inventor: Vernon R. Schimmel, Arlington Heights, Ill.

[73] Assignee: Symons Corporation, Des Plaines, Ill.

[21] Appl. No.: 736,860

[22] Filed: Dec. 6, 1976

[51] Int. Cl.[2] ..... E04G 15/06; B28B 7/30

[52] U.S. Cl. ..... 249/182; 249/171; 249/185

[58] Field of Search ..... 425/170, 171, 178, 179, 425/180, 181, 182, 184, 185, 192, 193, 194, 195

[56] References Cited

U.S. PATENT DOCUMENTS

| | | | |
|---|---|---|---|
| 853,955 | 5/1907 | Blaw | 249/194 X |
| 950,827 | 3/1910 | Smith | 249/185 |
| 988,048 | 3/1911 | Tingley | 249/185 X |
| 1,269,164 | 6/1918 | Davidson | 249/185 X |
| 2,313,880 | 3/1943 | Leggett | 249/194 X |
| 2,543,892 | 3/1951 | Carpenter | 249/194 X |
| 2,593,465 | 4/1952 | LeTourneau | 249/181 X |
| 2,618,834 | 11/1952 | Fioruzzi | 249/194 X |
| 2,854,725 | 10/1958 | Bast et al. | 249/181 |
| 2,929,125 | 3/1960 | McGinnis et al. | 249/185 X |
| 3,357,673 | 12/1967 | Williams | 249/194 X |
| 3,749,352 | 7/1973 | Khodosh et al. | 249/178 X |
| 3,917,216 | 11/1975 | Plough | 249/194 X |

FOREIGN PATENT DOCUMENTS

| | | | |
|---|---|---|---|
| 622,331 | 2/1927 | France | 249/185 |
| 885,436 | 12/1961 | United Kingdom | 249/178 |

*Primary Examiner*—J. Howard Flint, Jr.
*Attorney, Agent, or Firm*—Norman H. Gerlach

[57] ABSTRACT

An inside articulated and collapsible form adapted for use in the formation of a rectangular concrete corewall and having at its corners novel three-way hinge assemblies including main hinge leaves which are movable between right angular positions wherein the four form sides with which they are associated assume extended positions wherein their panel facings conform to the outline of the inside face of the corewall to be formed by pouring wet concrete around the form, and acute angle positions wherein such form sides assume collapsed positions which are inwardly removed from such outline while the hinge leaves constitute rub rails which guide the collapsed form axially along and within the surrounding hardened concrete corewall during removal of the form the formed corewall. Secondary hinge leaves at the outer or distal ends of the main hinge leaves afford attachment facilities for connecting the main hinge leaves to the form sides while locking flanges on the main hinge leaves are capable of being removably bolted to the secondary hinge leaves in order to maintain the form in its extended condition of use.

11 Claims, 9 Drawing Figures

INSIDE CONCRETE COREWALL FORM WITH PARTICULAR THREE-WAY HINGE ASSEMBLIES THEREFOR

The present invention relates generally to concrete forms and has particular reference to a novel inside articulated collapsible form which is adapated for use in the formation of a concrete corewall shaft and, when in its extended position, presents panel facings which conform to the rectangular outline of the inside wall surfaces of the corewall to be formed by pouring wet concrete around the form, and when in its collapsed position, causes such panel facings to be withdrawn inwardly from such outline so that the form is loosened from the hardened corewall-forming concrete and may then be shifted vertically or axially along the corewall into a position for use in connection with a subsequent concrete pour, depending upon whether the corewall to be formed is to extend vertically or horizontally.

Concrete corewalls of the character under consideration are commonly employed in the reaction of high-rise apartment and other buildings in the production of stairwells, elevator shafts, and the like. Corewalls are also cast in a horizontal position in connection with the creation of culverts, tunnels, or similar structures.

Heretofore it has been the practice, when constructing an articulated collapsible concrete form for the inside surfaces of a rectangular corewall, to utilize a hinge joint at the mid-point of each of the two long sides of the rectangular form so that when the joints are broken inwardly the articulated form collapses to produce a smaller form structure which has the outline of two truncated triangles which are connected in tandem fashion with their truncated corners joined together. The over-all outline of such a collapsed form structure being smaller than the outline of the expanded form structure enables the collapsed structure to clear the walls of the hardened concrete of the corewall so that the collapsed form structure may be shifted longitudinally along the corewall to a new position for a subsequent concrete pour or for removal purposes.

An articulated collapsible inside form structure of the character set forth above is possessed of certain limitations and principal among these is the lack of rigidity of the collapsed structure so that handling of the latter is quite difficult. Another limitation that is attendant upon the construction and use of such an articulated collapsible inside form structure resides in the fact that although the long sides of the form structure are bent inwardly, so to speak, the short sides of the structure are drawn away from their associated concrete corewall walls by only a small distance, thus materially limiting the freedom of movement of the collapsed form structure along the corewall when hoisting or otherwise shifting the same axially along the corewall. A further limitation resides in the fact that to produce maximum clearance of the short sides of the collapsed form structure from the inner surfaces of the adjacent walls of the corewall, large inward displacement of the hinge joints is necessary and the mechanics of effecting such displacement presents difficulty since the use of turnbuckle tension to effect the "break" of the hinge joints is precluded since a turnbuckle does not have the range to shorten itself to near the zero point. Furthermore, even with full inward displacement of the small sides of the form is slight and, during the hoisting operation, there is danger of these short sides rubbing against the freshly hardened concrete and either damaging the polished surfaces of the plywood panels which are associated with such short sides or effecting chipping of the concrete of which the formed corewall is made. As a matter of fact, some contractors have been obliged to resort to the use of skid sheets or rails within the corewall in order to prevent such damage or chipping. Where an extremely long and narrow corewall is concerned, this latter difficulty is increased since cosine considerations are such that very little inward shifting of the short sides of the form structure takes place until the angle between the split sections becomes extremely small and the two hinge joints closely approach each other. An additional limitation that is present in connection with an articulated collapsible form of this character resides in the fact that when the form is fully collapsed, the split long sides of the form establish, within the over-all confines of the collapsed form structure, an X-shaped barrier which precludes the operator from gaining entry into the form for tie-rod or other manipulations.

The present invention is designed to overcome the abovenoted limitations that are attendant upon the construction and use of present-day articulated collapsible inside concrete corewall forms and, toward this day, the invention contemplates the provision of a novel articulated collapsible inside concrete corewall form which has associated therewith a series of four novel three-way corner hinge assemblies each of which embodies a pair of main hinge leaves and a pair of secondary hinge leaves at the outer or distal ends of the main leaves. The secondary hinge leaves constitute attachment plates whereby the distal ends of the main hinge leaves are secured to the adjacent side margins of the long and short sides of the rectangular form. The form sides are rigid and, thus, when the main hinge leaves assume right angular conditions, the form sides assume expanded positions wherein their plywood facings conform to the outline of the inside surfaces of the concrete corewall which is to be poured. When the main hinge leaves assume acute angles, the rigid form sides are shifted inwardly while at the same time they maintain their right angular box-like relationship. The form sides thus move away from the adjacent inner side surfaces of the sides of the formed corewall and the collapsed form retains its rectangular shape but is of a smaller size so that ample clearance is afforded to accommodate the hoisting operation when the form is shifted bodily to a new location for a subsequent concrete pour. Although each of the four form sides continues to oppose adjacent side of the corewall, there is no danger of contact between the form sides and the inner surfaces of the side walls of the corewall because the collapsed acute angle hinge structure functions as a rub rail. Thus, with four rub rails, one at each order of the collapsed form, the latter is capable of making only four lines of contact with the formed corewall, such contact being only an occasional one when one or another of the rub rails happens to contact the concrete of which the corewall is made. If the corewall is a horizontally disposed one, as, for example, in the construction of a culvert or a tunnel, two of the rub rails will become effective during shifting of the form horizontally while the other two will remain clear of the concrete. Due to the fact that the collapsed concrete corewall form retains its rectangular shape, regardless of whether it is extended or collapsed, the interior thereof is at all times unobstructed and access may readily be had thereto without difficulty being encountered.

Another advantageous feature of the invention resides in the fact that no great inward displacement of any portion of the form is required to effect adequate all-around clearance from the concrete corewall, a series of four diagonally positioned turnbuckle devices, one adjacent to each corner of the form, is adequate not only to exert the necessary force for initial breaking of the bond between the panel facings of the form sides and the inner surfaces of the sides of the formed concrete corewall, but also by a relatively small degree of contraction to effect full form collapse. Additionally, the use of such turnbuckles affords no obstruction to interior access within the form regardless of whether the same be extended or collapsed. Still further, the turnbuckles may be, at least in part, relied upon to lend rigidity to the form both in its extended condition or in its collapsed condition, as well as in any intermediate position.

Each of the aforementioned three-way corner hinge assemblies has associated therewith means for positively yet releasably locking the form in its extended condition, such means assuming the form of a locking plate which extends at a right angle to each main hinge leaf and is fixed in such right angular relationship. When the main hinge leaves are disposed at a right angle to each other, the locking plates which are associated therewith lie flush with the secondary hinge leaves on the edges of the adjacent form sides and releasable bolt means are provided whereby they may be securely but releasably bolted to such secondary hinge leaves, thus locking the rectangular expanded box-like form in a rigid condition. Upon release of the bolt means, the main hinge leaves are free to collapse to an acute angle condition, thus collapsing the form in such a manner that it retains its box-like rectangular condition but assumes smaller proportions. As will become more readily apparent when the nature of the invention is better understood, when one type of form of panel unit is employed to make up each side of the form, a common bolt serves the same bolting means that releasably holds the clamping plate to the adjacent secondary hinge leaf and the bolting means that permanently holds the secondary clamping plate in fixed position on the adjacent form side. When another type or form of panel unit is employed to make up each side of the form, separate bolts are employed to perform these two bolting functions.

The provision of an inside articulated and collapsible concrete corewall form such as has briefly been outlined above and possessing the stated advantages constitutes the principal object of the present invention.

Numerous other objects and advantages of the invention, not at this time enumerated, will readily suggest themselves as the following description ensues.

The invention consists in the several novel features which are hereinafter set forth and are more particularly defined by the claims at the conclusion hereof.

In the accompanying six sheets of drawings forming a part of this specification, two illustrative embodiments of the invention are shown.

Figure 1:
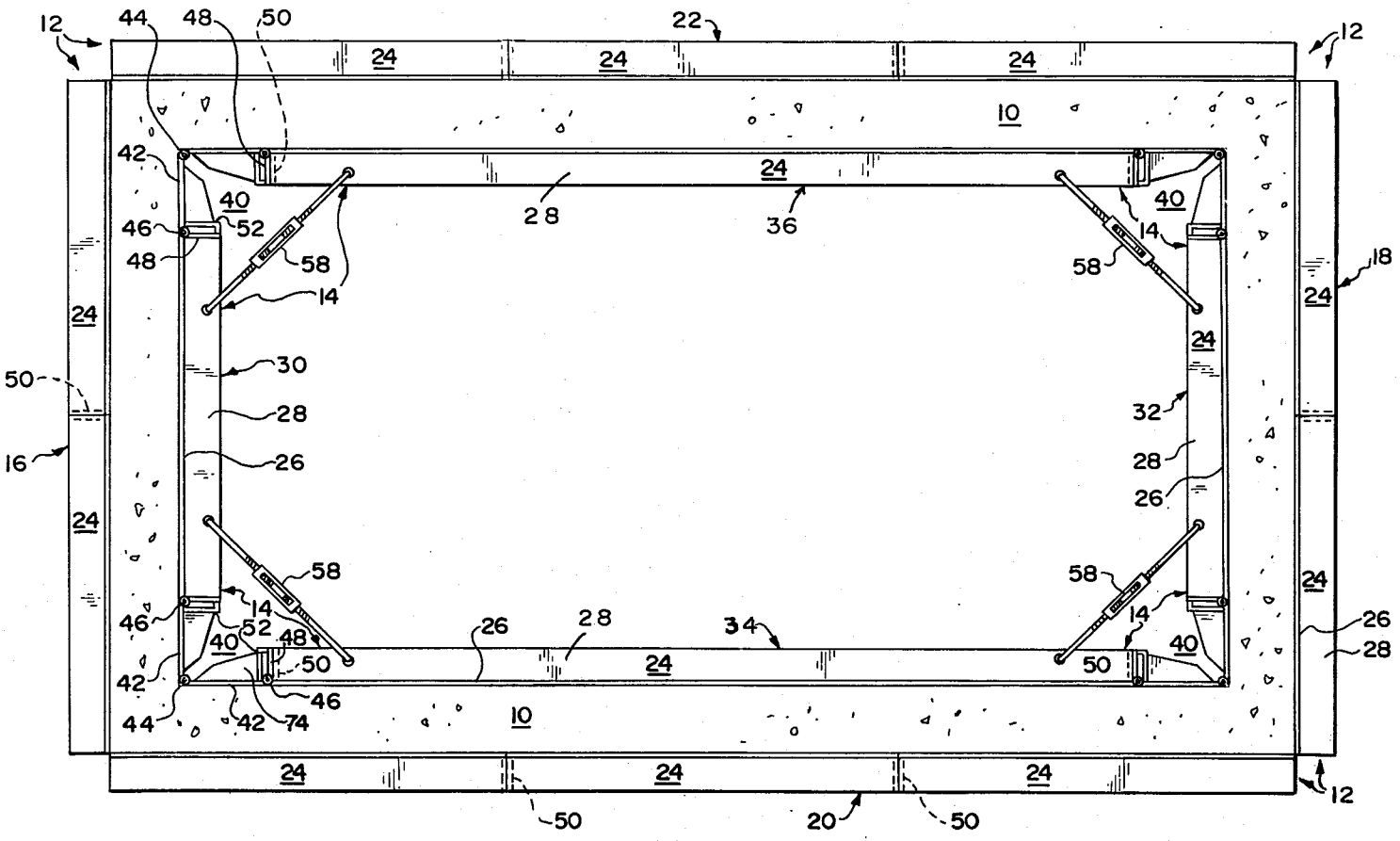
FIG. 1 is a plan view, somewhat schematic in its representation, looking downwards into a vertically disposed concrete corewall and showing the inside and outside form panels in position on the corewall preparatory to stripping of the two forms therefrom.
Figure 2:
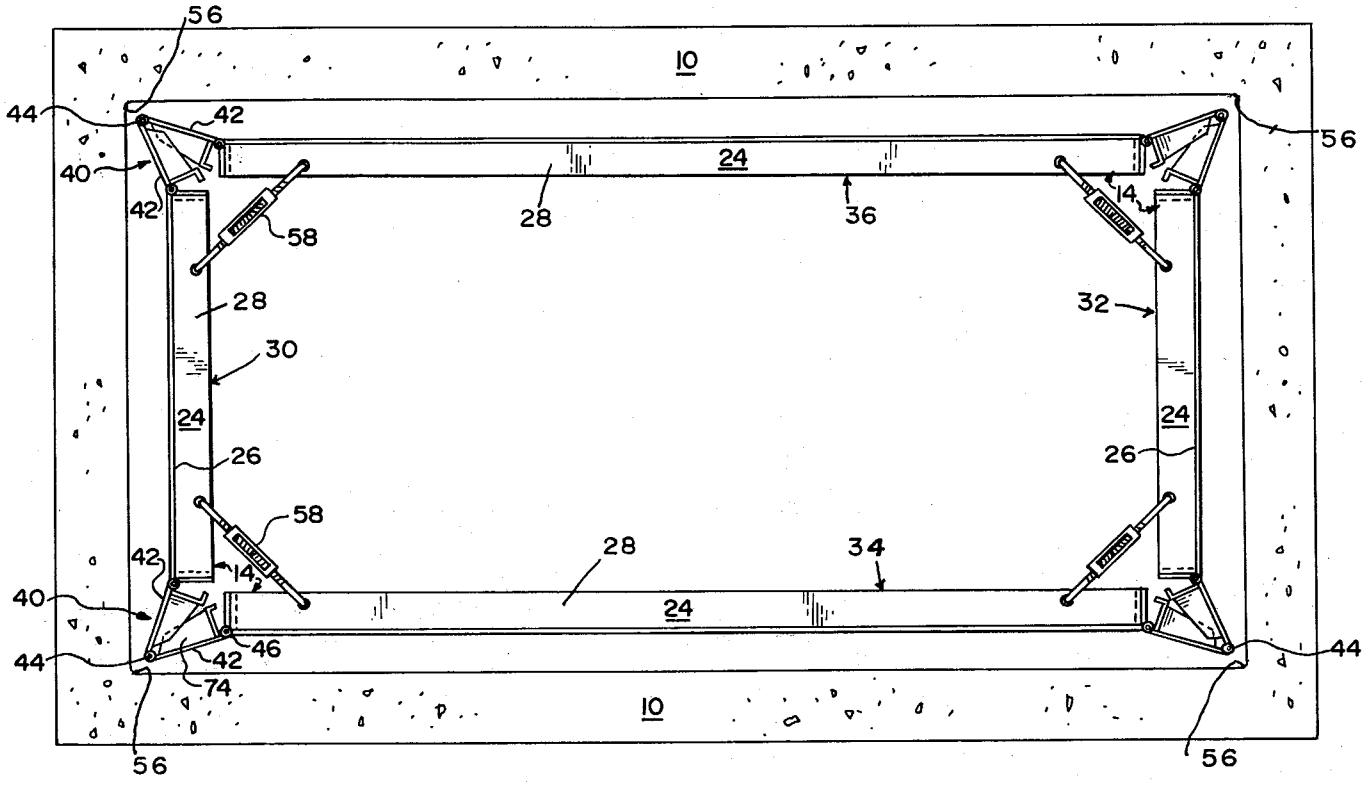
FIG. 2 is a plan view similar to FIG. 1 but showing the outside form panels removed and the inside form panels collapsed by means of four of the three-way hinge assemblies of the present invention.

Referring now to the drawings in detail and in particular to FIGS. 1 and 2, there is disclosed in these views a rectangular concrete corewall 10 which, for purposes of discussion herein, may be regarded as being a vertical elevator shaft or stairwell in a high-rise building which is under construction and is formed for the most part of concrete. The present invention is concerned with the construction of such a shaft-like corewall and this is accomplished in the usual manner by pouring wet concrete between a continuous rectangular outside form such as the illustrated form 12 and a continuous rectangular inside form 14.

The outside concrete corewall form 12 as described herein is of conventional construction and is comprised of a series of quadrilaterally arranged form sides including left and right sides 16 and 18 (see FIG. 1), and front and rear form sides 20 and 22. Each of the various form sides is comprised of a gang or series of panel units 24, the number of units in each gang depending, of course, upon the dimensions of the corewall 10. In the illustrated outside concrete corewall form, the left and right form sides 16 and 18 embody two such panel units 24 each, while the front and rear form sides 20 and 22 embody three such panel units 24 each.

The particular panel units 24 which are employed for the inside and outside concrete corewall forms 12 and 14 may vary widely, but for purposes of illustration herein, panel units of the "Versiform" type have been selected for exemplary illustration herein. A "Versiform" panel is a steel-clad panel consisting of a rectangular plywood facing which is bounded by a rectangular marginal steel frame. Such panels are manufactured and sold by Symons Corporation of Des Plaines, Ill. and for a full understanding of the nature of a "Versiform panel," reference may be had to a brochure which was published in 1974 by Symons Corporation and is entitled "Vertical Forming Systems." As shown throughout the drawings, each of the various panel units 24 regardless of whether they be associated with the inside concrete corewall form 14 or the outside form 12, includes a multi-ply plywood facing 26 and a marginal steel frame 28.

The inside concrete form 14 is of novel construction and it is essentially an articulated form which is collapsible as will be pointed out in detail hereafter and consists of left and right form sides 30 and 32, and front and rear form sides 34 and 36, adjacent panel units being connected together by novel three-way corner hinge assemblies 40. For convenience of illustration, each of these last mentioned form sides 30, 32, 34, and 36 of the inside corner corewall form 14 is comprised of a single "Versiform" panel unit 24, although if the size of the corewall 10 requires it, any or all of these form sides may be comprised of an appropriate number of "Versiform" panel units in gang or series form.

Figure 3:
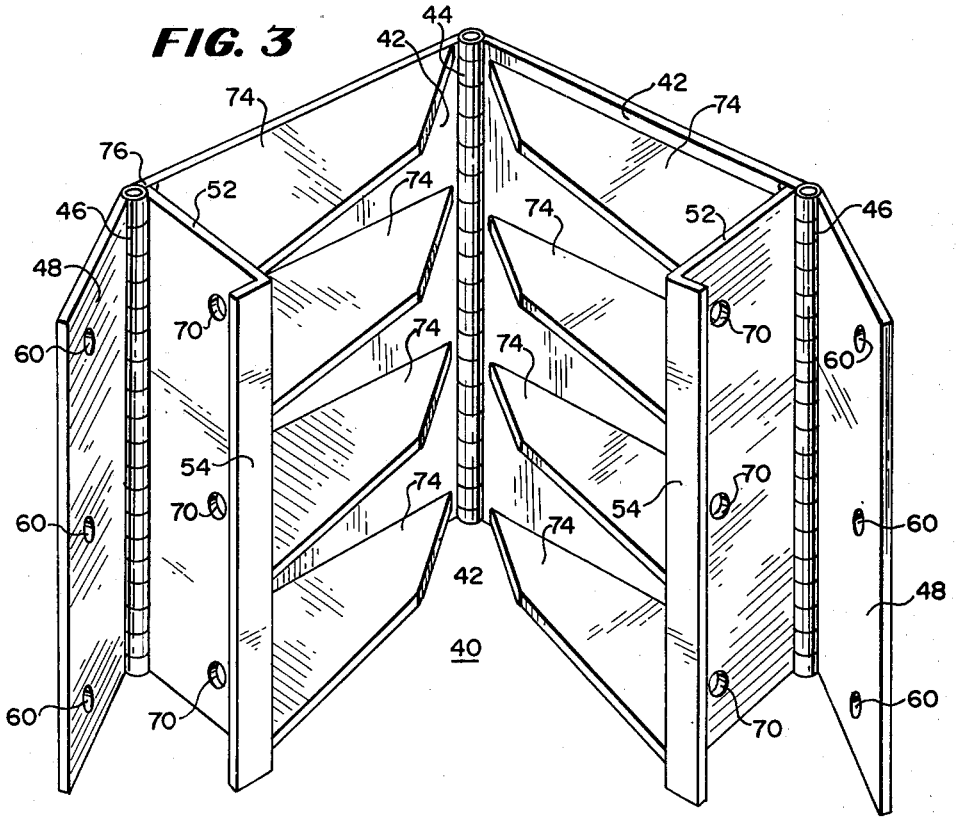
FIG. 3 is an enlarged perspective view of one of the three-way corner hinge assemblies which are shown in FIG. 2.
Figure 4:
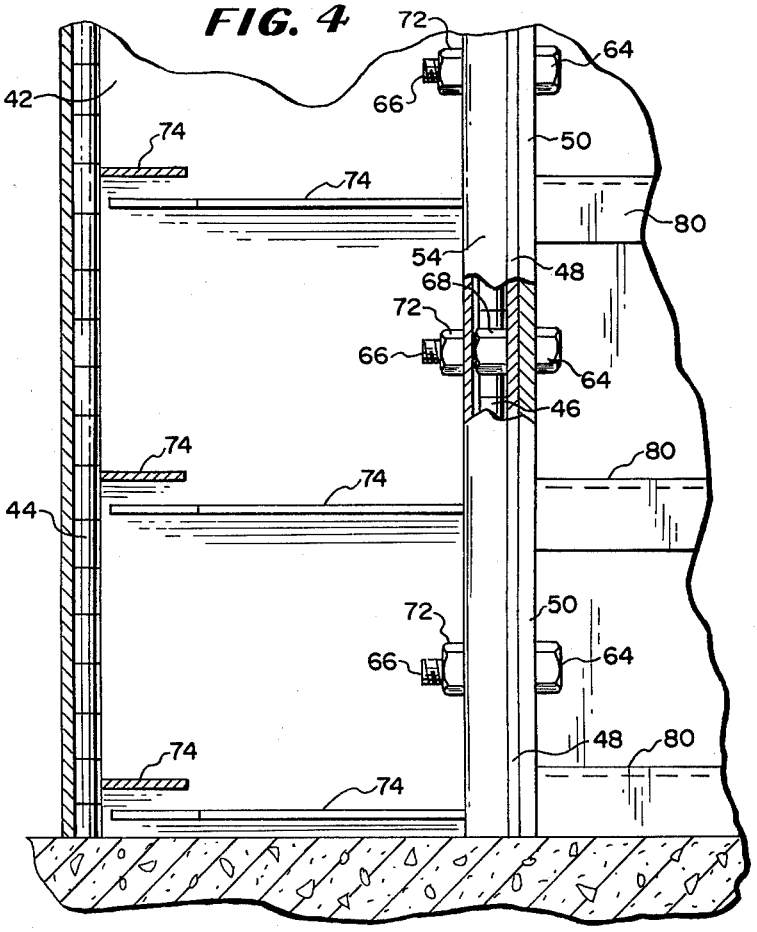
FIG. 4 is an enlarged fragmentary sectional view taken on a medial horizontal plane through one corner of the corewall of FIG. 1 and showing the associated three-way hinge assembly in its extended position.

Referring now additionally to FIG. 3 of the drawings, each of the three-way corner hinge assemblies 40 is preferably formed of stainless steel and involves in its general organization a pair of elongated main hinge leaves 42 which are connected together by their proximate side edges by a piano-type hinge 44. Pivotally connected to the distal edge of each of the main hinge leaves 42 by means of a piano-type hinge 46 is a secondary hinge leaf 48 of materially shorter extent than the main hinge leaf. As shown in FIGS. 1 and 4, these secondary hinge leaves 48 are designed for attachment to the vertical frame members or rails 50 of the marginal steel frames 28 of the adjacent panel units 24. Each hinge assembly 40 further includes a pair of locking plates 52, each of which extends tangentially outwardly from the adjacent distal piano-type hinge 46 and at a right angle to the associated main hinge leaf 42 and has its inner side edge welded to the adjacent distal side edge of said associated main hinge leaf 42 as indicated at 53. The outer or distal side edge region of each locking plate 52 is turned laterally outwards in order to provide a right angle flange 54, the function of which will be described presently. Such flange may be either continuous as shown in the drawings or interrupted.

Considering now the function of the main hinge leaves 42 and the secondary hinge leaves 48, and disregarding for the moment the locking plates 52, reference to FIG. 1 of the drawings will disclose the fact that when the two main hinge leaves 42 of each of the four corner hinge assemblies 40 extend at a right angle to each other, the secondary hinge leaves 48 will extend at right angles to their adjacent main hinge leaves 42 and a rigid box-like form structure of continuous rectangular configuration will obtain, the plywood facings 26 of each of the four panel units 24 lying flush with the adjacent inside side surface of the corewall 10, this, of course, being the condition of the inside articulated form 14 at the time wet concrete is poured between the outside and inside forms 12 and 14 in connection with the formation of the corewall 10. The main hinge leaves 42 of the three-way hinge assemblies 41 constitute, in effect, continuations of the outer surfaces of the plywood facings 26 of the associated panel units 24, the piano-type hinges 44 establishing rounded corners 56 of small radii on the inside of the corewall 10, this being a desirable feature in the finished corewall.

When the main hinge leaves 42 of the four three-way hinge assemblies 40 are collapsed or swung inwards so as to extend at an acute angle to each other as shown in FIG. 2, the four panel units 24 are shifted bodily inwardly toward one another so that the plywood facings 26 thereof are drawn away from the inner side surfaces of the corewall 10 while the four panel units 24 still maintain a rigid box-like structure of rectangular configuration but of smaller over-all dimensions. The hinge assemblies 40 at this time lie for the most part interiorly of the confines of the rectangular inner surface of the corewall 14 and the piano-type hinges 46 thereof are drawn slightly inwardly and away from the rounded corners 56 so as to provide adequate clearance when hoisting operations are performed upon the thus collapsed inside form 14 so as to bring the form as a whole from one level to another, all in a manner that will be made clear subsequently. The rigidity of the inside concrete corewall form 14 is maintained, either when it is in its extended condition as shown in FIG. 1 or in its collapsed condition as shown in FIG. 2, by means of conventional turnbuckles 58 which extend horizontally across the corner regions of the form and are attached at their ends to the horizontal members or rails of the rectangular steel reinforcing frames 28 of the panels 24.

Referring now to the three-way hinge assembly 40 which is shown or illustrated in FIG. 3 of the drawings, the secondary hinge leaves 48 are each provided with a vertical series of spaced apart circular bolt holes 60, such bolt holes being designed for register with similar bolt holes 62 which exist in the vertical frame members or rails 50 (see FIG. 4) of the steel reinforcing frames 28 of the various panel units 24 to which the hinge leaves 48 are attached. Such attachment is accomplished by means of horizontally extending bolts 64 embodying elongated externally threaded shanks 66 which pass through the registering bolt holes 60 and 62 and have mounted thereon clamping nuts 68. When the clamping nuts 68 are tightened, the secondary hinge leaves 48 are drawn hard against the outer surfaces of the adjacent vertical frame members or rails 50 of the associated panel units 24. In erecting the inside concrete corewall form 14, the unions which are effected by the bolts 64 and their clamping nuts 68 are permanent ones so that the secondary hinge leaves 48 of the three-way hinge assemblies 40 remain at all times attached to their associated panel units 24.

Still referring to FIGS. 3 and 4 of the drawings, the locking plates 52 of the three-way hinge assemblies 40 are provided with vertical series of spaced apart circular bolt holes 70, the latter being so disposed that when the locking plates 52 are brought into parallelism with the adjacent secondary hinge leaves 48 and with the distal edges of their right angle flanges 54 abutting said secondary hinge leaves 48, the shanks 66 of the bolts 64 will pass through the bolt holes 70 as shown in FIG. 4 so that additional nuts 72 may be applied to the bolt shanks 66 outwardly of the clamping nuts 68 so as to draw the flanges 54 against the secondary hinge leaves and thus lock the hinge assemblies 40 in their extended right angular position with the locking plates 52 in parallel relation with the secondary hinge leaves. If desired, welded-in-place spacing pads (not shown) may be used instead of the integral out-turned flanges 54.

Figure 6:
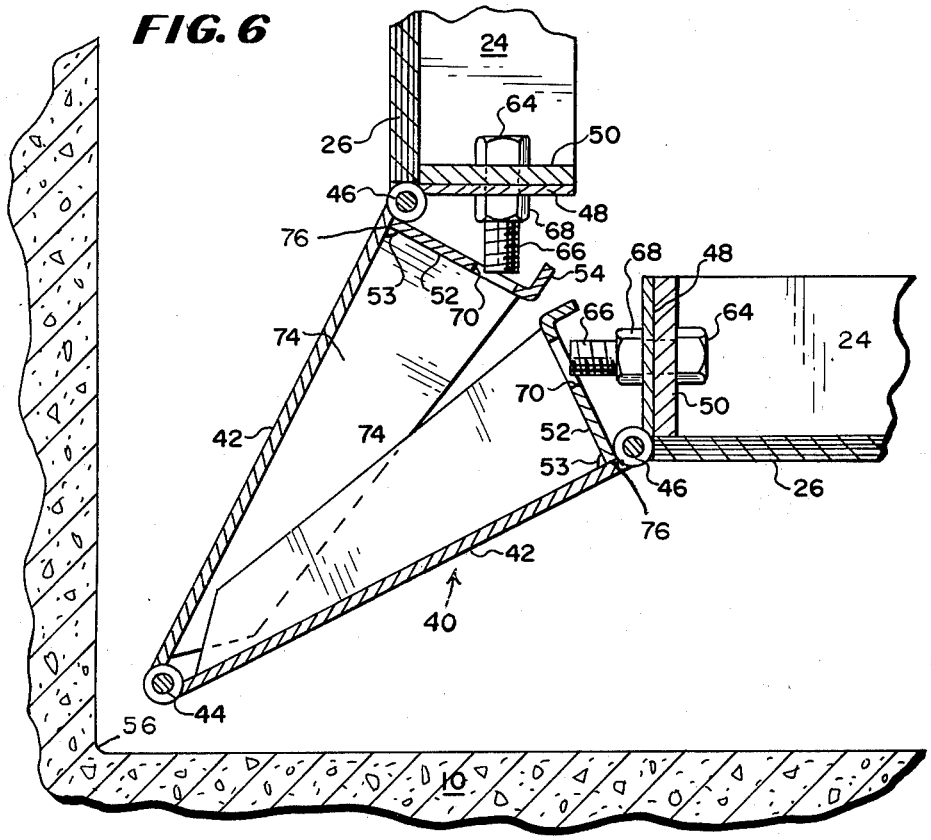
FIG. 6 is a vertical sectional view taken on the line 6—6 of FIG. 4.

In order to reinforce the locking plates 52 and the main hinge leaves 42 of the hinge assemblies 40 and also rigidly to maintain them in their proper right angular relationship, vertical series of horizontally extending spaced apart gusset plates 74 of trapezium shape or configuration are provided, and these gusset plates have right angle corners 76 which seat along the juncture lines between the locking plates 52 and the main hinge leaves 42 and are welded in on-edge fashion to both the locking plates and said leaves. As shown in FIGS. 2 and 6 of the drawings, when the inside concrete corewall form 14 is in its collapsed condition so that the main hinge leaves 42 assume their acute angle relationship as previously described, the gusset plates 74 on the main hinge leaves 42 overlap each other by reason of the fact that the plates of one vertical series are staggered or offset with respect to the gusset plates of the adjacent series.

Figure 5:
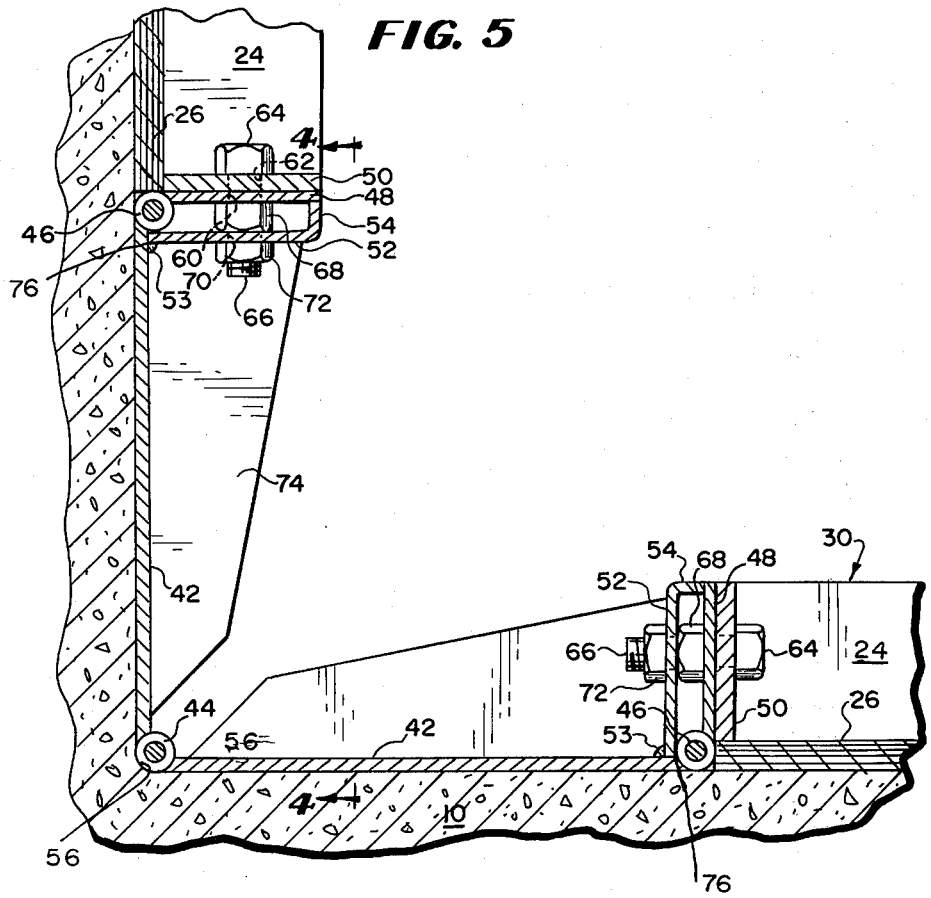
FIG. 5 is an enlarged fragmentary sectional view taken on a horizontal medial plane through one corner of the corewall of FIG. 2, the associated three-way hinge assembly being shown in its collapsed position.

It will be understood that, depending upon the size or dimension of the corewall 10 and of the panel units 24 which are employed in constructing the inside form 14, the longitudinal extent of the hinge assembly 40 will be commensurately varied. In the exemplary form of the invention, four gusset plates 74 on each main hinge leaf 42 are disclosed, but a greater or lesser number of such gusset plates may be employed if desired. Obviously, the gusset plates 74 on adjacent main hinge leaves 42 will be staggered as heretofore mentioned and as clearly shown in FIG. 5 in order to avoid interference when collapsing the form 14.

The rectangular marginal steel frame 28 of each of the "Versiform" panel units 24 which is associated with and forms a part of the inside concrete corewall form 14 is, as best shown in FIG. 6, provided with the usual horizontal members or rails 80 and these are preferably of channel design. The aforementioned turnbuckles 58 which extend across the corner regions of the form 14 may conveniently have their ends applied to the crossbars 80 of adjacent panel units 24 at the same horizontal level, a single turnbuckel at each corner being ordinarily adequate for form collapsing and extending purposes, although plural turnbuckles at different elevations may be employed if desired.

Referring now to FIG. 1, and assuming that wet concrete has been poured between the outside concrete corewall form 12 and the inside concrete corewall form 14 and that the concrete has become set and produced the corewall 10, and further assuming that the first formed corewall 10 is only a foundation unit which was created at a given floor level in a building undergoing erection and that it is desired to continue upwards the originally formed corewall 10 at the next higher level by performing a second concrete pour, according to the present invention, it is contemplated that the outside concrete wall form 12 will be dismantled or removed and that the inside concrete corwall form 14 will be collapsed without dismantling so that it assumes the condition in which it is illustrated in FIG. 2. In its collapsed condition, the articulated form 14 is entirely free of the inside surfaces of the sides of the originally formed corewall 10 so that by the use of an overhead crane or the like, it may be hoisted to the next floor level above at which point the form 14 may be expanded back to the condition shown in FIG. 1, and a fresh pour made on top of the original pour in order to form an upward extension of the originally poured corewall.

Collapsing of the inside concrete corewall form 14 is readily accomplished by the simple expedient of removing the outer clamping nuts 72 from the shanks 66 of the various bolts 72 (see FIG. 4) at each corner region of the form and then manipulating the turnbuckles 58 in a collapsing direction. Such collapsing or contraction of the turnbuckles will draw the various main leaves 42 of the four hinge assemblies 40 toward each other and decrease the angle between each pair of hinge leaves 42. As the leaves 42 thus swing inwardly of the corewall 10, the fixed locking plates 52 will become released and will swing from the position illustrated in FIG. 4 to the position illustrated in FIG. 6. In so swinging, the locking plates will clear the exposed outer ends of the shanks 66 of the bolts 64, while the inner nuts 68 will maintain the panel units 24 fixedly secured to the secondary hinge leaves 42 of the hinge assemblies 40. Such collapsing of the inside concrete corewall form 14 by means of the turnbuckles 58 may be continued until the operator adjudges that the form as a whole has been collapsed to the point where there is sufficient clearance between the plywood facings 26 of the panel units 24 and the inner side surfaces of the formed corewall 10 to allow hoisting of the form within the corewall without interference. The limit of such collapsing occurs when the two out-turned right-angle flanges 54 (see FIG. 5) on the locking plates 52 touch each other. At this time, a suitable cable or chain connection may be made between the thus collapsed inside concrete corewall 14 and an overhead crane or the like (not shown) and the aforementioned hoisting operation performed.

It is to be noted at this point that during the hoisting operation there is no danger whatsoever of the plywood facings 26 of the panel units 24 touching or scraping against the relatively rough inside surfaces of the previously poured corewall 10. This is because the geometry of the hinge assemblies 40 is such that all of the plywood facings 26 shift inwards and away from their opposed corewall side walls an appreciably greater distance than do the hinge assemblies 44. Thus, during actual hoisting operations, the four hinge assemblies 44 function as rub rails and conform the inside concrete corewall form to a minimum of loose swinging motion within the formed corewall during hoisting.

After the inside concrete corewall form 14 has been hoisted to the desired level within the building, i.e., preferably to a level where such form is not quite out of the previously formed corewall section, the turnbuckles 58 may be actuated to elongate them and, consequently, to expand the collapsed form 14 back to its expanded or operative position as shown in FIG. 1 of the drawings.

Under some circumstances, as, for example, if the corewall 10 to be formed is relatively large, conventional horizontally positioned tie rods (not shown) may be inserted through and anchored to the pairs of opposed panel units 24 of the inside and outside concrete corewall forms and, after the pouring operation and hardening of the concrete, their projecting ends may be wrested from the concrete of the formed corewall 10 in the usual manner and the medial regions of the tie rods allowed to remain embedded in the side portions of said corewall. However, where a relatively small corewall 10 is concerned, the compression which is offered by the turnbuckles 58 is adequate to maintain the necessary rigidity of the form 14 to withstand the pressure of the concrete during the pouring operation.

Although the corewall 10 has been previously discussed herein in connection with vertical shifting operations of the inside concrete corewall form 14, as, for example, in the creation of an elevator shaft or a stairwell, the invention is equally applicable to a corewall which is horizontally disposed, as, for example, a culvert, tunnel, or the like. In such an instance, little if any modification of the inside concrete corewall form 14 need be made and when the same is shifted horizontally to a new position, the two lowermost three-way hinge assemblies 40 will function as rub rails and assimilate the weight of the collapsed form 14.

Under certain circumstances, it may be desirable to employ other forms of steel-clad panel units instead of the aforementioned "Versiform" panel units. One such panel unit which has been found admirably well-adapted for use in connection with the present invention is a panel which is known as a "Steel-Ply" panel. Such a panel is also manufactured and sold by Symons Corporation, previously mentioned. A typical "Steel-Ply" panel unit is shown and described in U.S. Pat. No. 3,357,673, granted on Dec. 12, 1967, and entitled "CONCRETE WALL FORM WITH A PARTICULAR PANEL HINGE ARRANGEMENT." In FIGS. 7, 8, and 9 of the drawings of the present patent application, the manner in which a "Steel-Ply" panel unit may be attached to the locking plate 52 of one of the hinge assemblies 40 is disclosed.

Figure 7:
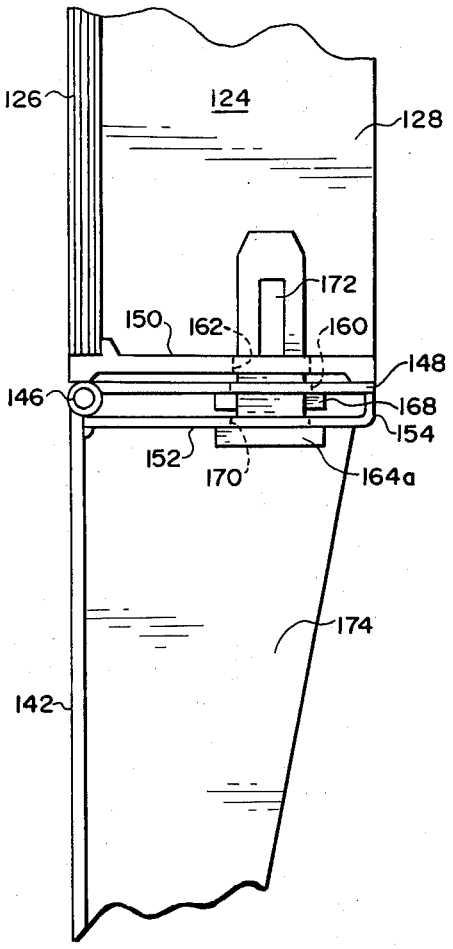
FIG. 7 is a fragmentary horizontal sectional view of one compound leaf portion of a three-way corner hinge assembly for a concrete corewall form embodying the present invention, such compound leaf portion being shown in its collapsed condition or positioned and applied to an adjacent panel of the "Steel-Ply" variety.
Figure 8:
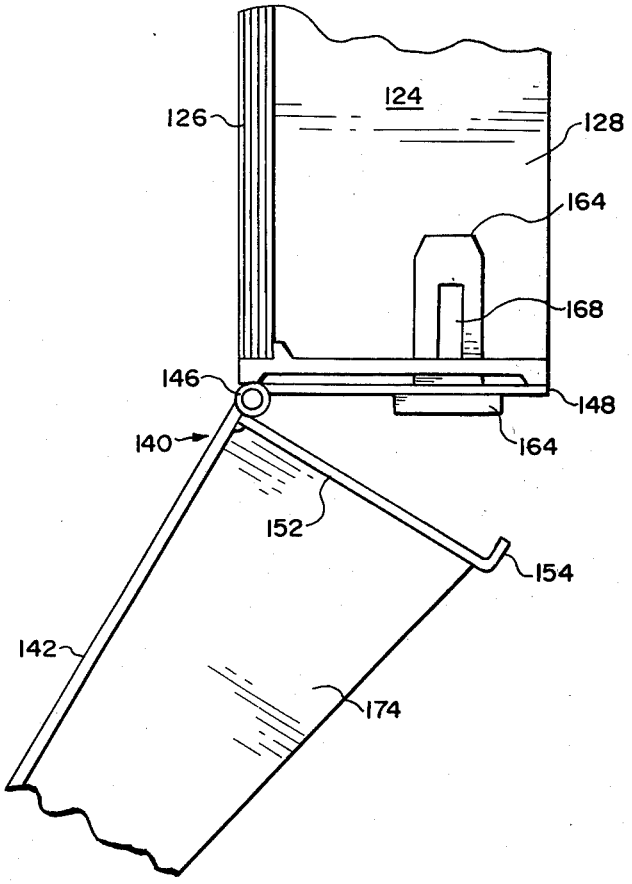
FIG. 8 is a fragmentary horizontal sectional view similar to FIG. 7 but showing the compound leaf portion in its extended or open condition.
Figure 9:
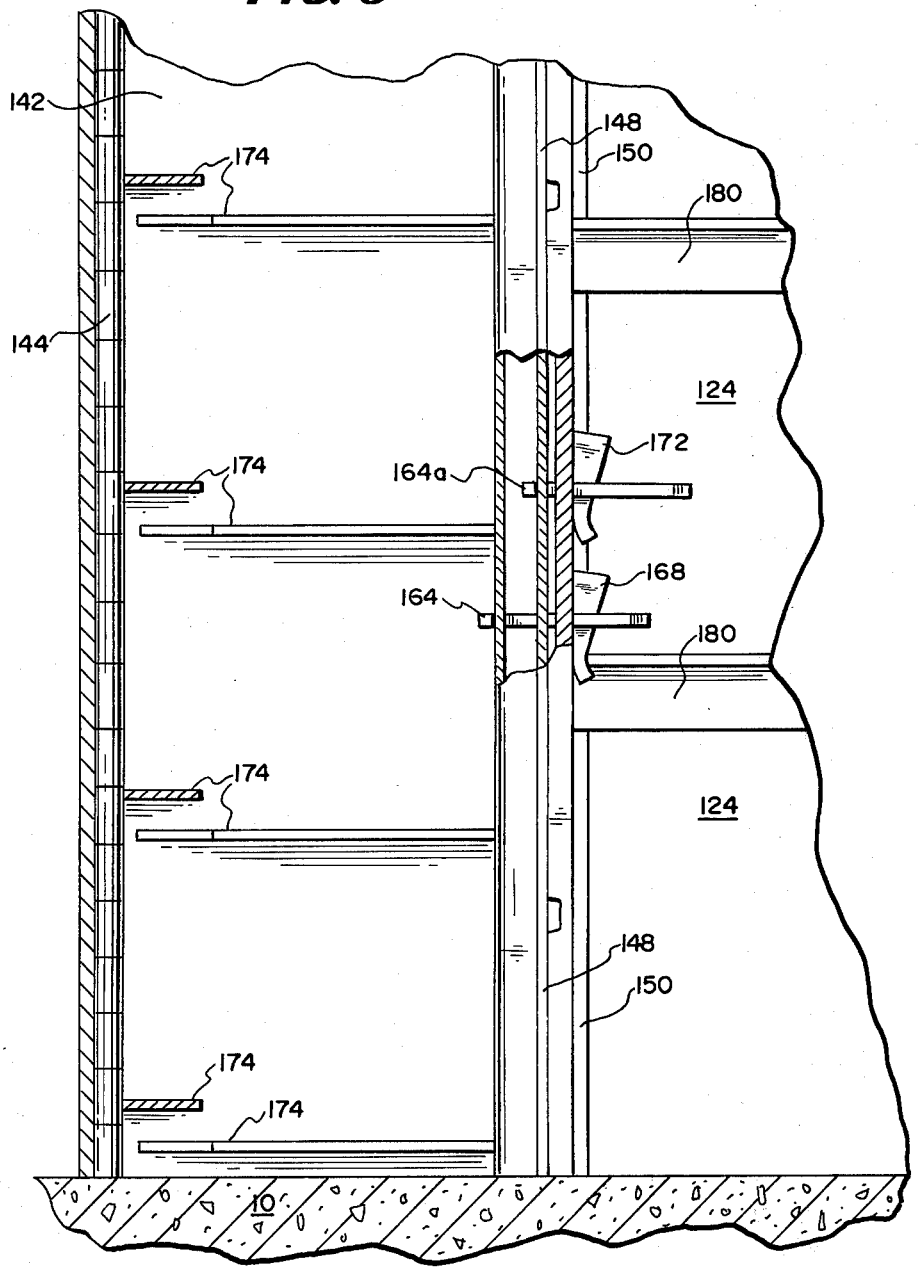
FIG. 9 is a vertical sectional view similar to FIG. 6 but showing "Steel-Ply" panels substituted for the "Versiform" panels of FIGS. 1, 2, 4, 5 and 6.

In view of the similarity between the modified form of the invention which appears in FIGS. 7, 8, and 9 and the previously described form of the invention, similar reference numerals but of a higher order have been applied to the corresponding parts as between the disclosures of FIGS. 7 and 8 on the one hand, and FIGS. 4 and 6 on the other.

In this latter form of the invention, each three-way hinge assembly 140 remains substantially the same as each of the hinge assemblies 40 of the inside concrete corewall form 14, the only exception or difference being that the locking plate 152 is provided with a vertical series of spaced apart horizontally extending slots 170 in place of the holes 70. Similarly, the secondary hinge leaf 148 is provided with horizontally extending slots 160 in place of the holes 60. "Steel-Ply" panel units such as the panel unit 124 of FIGS. 7, 8, and 9 are invariably provided with side frame members or side rails 150 having aligned or registering horizontally extending slots 162 therein and adjacent panel units are connected together by means of wedge and bolt assemblies in the manner shown and described in aforementioned U.S. Pat. No. 3,357,673. In the modified form of the invention, the clamping nut and bolt assembly 68 and 64 of FIG. 4 is replaced by a wedge and bolt assembly 168 and 164 (see FIG. 8), while the locking nut and bolt assembly 72 and 64 is replaced by a wedge and bolt assembly **172, 164*a* (see FIG. 7). In the case of the "Versiform" panel unit which is shown in FIG. 4 of the drawings, it is possible to place the clamping nut 68 and the locking nut 72 on the same bolt 64. However, where wedge and bolt assemblies are concerned, two wedges cannot be associated with the same bolt due to space limitations and, therefore, separate bolts 164 and 164*a* are employed where "Steel-Ply" panel units are concerned. It is necessary, of course, that the wedge and bolt assemblies 168 and 164 and wedge and bolt assemblies 174 and 164*a* be disposed at different elevations so as to avoid interference and, accordingly, as clearly shown in FIG. 9, pairs of vertically spaced bolt-receiving slots 162 are employed in the secondary hinge leaves of the three-way hinge assemblies 140** in order to receive both types of wedge and bolt assemblies.

It is to be understood that in collapsing the articulated inside concrete corewall form which embodies "Steel-Ply" panel units and is shown in FIGS. 7, 8 and 9, the wedge and bolt assemblies 172 and 164a will initially be removed in order to free the locking plates 152 of the hinge assemblies 140 from the adjacent secondary hinge leaves 148 preparatory to actuating the turnbuckles for form collapsing purposes. The wedge and bolt assemblies 164 and 168 remain permanently in position in order to hold the secondary hinge leaves 148 fixedly secured to the adjacent vertical frame members or rails 150 of the "Steel-Ply" panel units. Otherwise, the method of collapsing and expanding the articulated inside concrete corewall form of FIGS. 7, 8, and 9 remains precisely the same as that of previously described articulated inside concrete corewall form 14.

The invention is not to be limited to the exact arrangement of parts shown in the accompanying drawings or described in this specification as various changes in the details of construction may be resorted to without departing from the spirit or scope of the invention. For example, in its broadest aspect it is within the purview of the invention to dispense with the locking plates 52 on one or more of the three-way hinge assemblies 40, in which case other means such as spreader and tie rod assemblies similar to those shown in aforementioned U.S. Pat. No. 3,357,673 may be employed in order releasably to maintain the inside concrete corewall form 14 in its expanded condition. Additionally, the invention is not limited to the use of either "Versiform" or "Steel-Ply" panel units and, when other types of panel units are employed in the construction of the inside form 14, consideration will be given to the character of the side members or rails of such panel units and the bolt hole spacing of the secondary leaves 42 will be modified accordingly. Therefore, only insofar as the invention is particularly pointed out in the accompanying claims is the same to be limited.

I claim:

1. An inside articulated and collapsible concrete form for a rectangular corewall, said form comprising four form sides arranged in quadrilateral relationship, each side including an outwardly disposed facing with a marginal reinforcing frame having side and end rails, and a three-way corner hinge assembly operatively connecting each pair of adjacent end rails together, each hinge assembly embodying a pair of elongated main hinge leaves having their proximate ends hingedly connected together for swinging movement of the leaves toward and away from each other between an extended position wherein such leaves define a right angle, and a collapsed position wherein such leaves define an acute angle, and a pair of secondary hinge leaves having their proximate ends hingedly connected to the distal ends of said main hinge leaves, and means for fixedly securing each of said secondary hinge leaves to the adjacent end rail, said main hinge leaves, when in their right angular relationship, serving to maintain the form in a fully expanded condition wherein each of said facings is coplanar with one main hinge leaf of each adjacent hinge assembly so that the peripheral outline of the form as a whole conforms to the outline of the inner surfaces of the corewall which is to be formed, said main hinge leaves of the hinge assemblies, when assuming identical acute angle relationships, serving to maintain said form sides in a quadrilateral right angular relationship and with their facings spaced inwards of said peripheral outline of the form when in its extended position.

2. An inside articulated and collapsible concrete form as set forth in claim 1 and wherein a locking plate extends at a right angle from the distal end of each main hinge leaf in the immediate vicinity of the hinge connection for the associated secondary hinge leaf, and means are provided for releasably securing said locking plate to such secondary hinge leaf.

3. An inside articulated and collapsible concrete form as set forth in claim 2 and wherein said releasable securing means for the locking plate comprises a clamping bolt effective between said locking plate and the adjacent end rail.

4. An inside articulated and collapsible concrete form as set forth in claim 3 and wherein the means for securing each secondary hinge leaf to its adjacent end rail comprises a clamping bolt effective between such secondary hinge leaf and end rail.

5. An inside articulated and collapsible concrete form as set forth in claim 4 and wherein the releasable securing means for the locking plate and the securing means for the secondary hinge leaf embodies a common nut-equipped clamping bolt which passes loosely through respective openings in said adjacent end rail, the secondary hinge leaf and the locking plate.

6. An articulated collapsible concrete form as set forth in claim 1 and wherein a locking plate extends at a right angle from the distal end of each main hinge leaf in the immediate vicinity and inwards of the hinge connection for the associated secondary leaf, a laterally and outwardly extending spacing member is provided on the distal edge of said locking plate, a clamping bolt has its shank portion extending through openings in the adjacent end rail, said secondary hinge leaf and the locking plate respectively, a first nut is threadedly received on said shank between the locking plate and said secondary hinge leaf for permanently clamping the secondary hinge leaf to said adjacent end rail, and a second nut is threadedly and removably received on said shank for releasably drawing said locking plate toward said secondary hinge leaf and end rail and causing said spacing member to seat against said secondary hinge leaf.

7. An articulated collapsible concrete form as set forth in claim 6 and wherein the laterally and outwardly extending spacing member is in the form of an integral out-turned flange.

8. An inner articulated and collapsible concrete form as set forth in claim 1 and wherein a turnbuckle extends diagonally across each corner region of adjacent form sides, has its opposite ends pivotally connected to such form sides, and is effective upon manipulation thereof to collapse and extend said form.

9. An inner articulated and collapsible concrete form for a rectangular corewall, said form comprising four form sides arranged in quadrilateral relationship, each side including a facing and a marginal reinforcing frame including side and end rails, and a three-way corner hinge assembly operatively connecting each pair of adjacent end rails together, each hinge assembly embodying a pair of elongated main hinge leaves hingedly connected together for swinging movement toward and away from each other between an extended position wherein such leaves define a right angle, and a collapsed position wherein such leaves define an acute angle, a pair of secondary hinge leaves their having proximate ends hingedly connected to the distal ends of said main hinge leaves, a locking plate extending at a right angle from the distal end of said main hinge leaf in the immediate vicinity of the hinge connection for the associated secondary hinge leaf, a first clamping bolt having a slotted shank extending through openings in the adjacent end rail and said secondary hinge leaf, a removable wedge member extending through the slot in said shank and serving to draw said secondary hinge leaf against the end rail, a secondary clamping bolt having a slotted shank extending through openings in the adjacent end rail, said secondary hinge leaf, and the locking plate, and a second removable wedge member extending through the slot in the shank of said second bolt and serving to draw the locking plate against the secondary hinge leaf.

10. An inside articulated and collapsible concrete form as set forth in claim 9 and wherein said clamping bolts are disposed at different transverse levels with respect to the axis of the form as a whole.

11. An inside articulated and collapsible concrete form as set forth in claim 10 and wherein turnbuckles extend diagonally across the corner regions of adjacent form sides and are effective upon manipulation thereof to collapse and extend the form.

* * * * *